US005114501A

United States Patent [19]

Ames et al.

[11] Patent Number: 5,114,501

[45] Date of Patent: May 19, 1992

[54] METHOD EMPLOYING SKIN-PASS ROLLING TO ENHANCE THE QUALITY OF PHOSPHOROUS-STRIPED SILICON STEEL

[75] Inventors: S. Leslie Ames, Sarver; Jeffrey M. Breznak, Springdale, both of Pa.

[73] Assignee: Allegheny Ludlum Corporation, Pittsburgh, Pa.

[21] Appl. No.: 680,230

[22] Filed: Apr. 4, 1991

Related U.S. Application Data

[62] Division of Ser. No. 435,142, Nov. 9, 1989, Pat. No. 5,041,170.

[51] Int. Cl.[5] ..... H01F 1/04

[52] U.S. Cl. ..... 148/117; 148/113

[58] Field of Search ..... 148/111, 112, 113, 122

[56] References Cited

U.S. PATENT DOCUMENTS 4,904,314 2/1990 Ames et al. ..... 148/113

FOREIGN PATENT DOCUMENTS 0086807 5/1985 Japan .

0095296 4/1988 Japan .

*Primary Examiner*—R. Dean

*Assistant Examiner*—Sikyin Ip

*Attorney, Agent, or Firm*—Patrick J. Viccaro

[57] ABSTRACT

An improvement in a method for improving the magnetic domain wall spacing of grain-oriented silicon steel sheet having an insulating coating thereof, wherein the sheet is subjected to metallic contaminants, particularly phosphorus and phosphorus compounds, to refine magnetic domains, followed by a rolling procedure, followed by a stress relief anneal to provide a smooth surface on the sheet and reduced core loss.

5 Claims, 2 Drawing Sheets

METHOD EMPLOYING SKIN-PASS ROLLING TO ENHANCE THE QUALITY OF PHOSPHOROUS-STRIPED SILICON STEEL

This is a division of application Ser. No. 07,435,142 filed Nov. 9, 1989.

This invention relates to a method of improving the surface smoothness and magnetic properties of grain-oriented silicon steel. More particularly, the invention relates to a method of improving the surface smoothness of grain-oriented silicon steel which has been domain refined using contaminants or intruders.

Grain-oriented silicon steel is conventionally used in electrical applications, such as power transformers, distribution transformers, generators, and the like. The steel's ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture, (110) [001] in terms of Miller's indices, results in improved magnetic properties, particularly permeability and core loss over nonoriented silicon steels. The Goss texture refers to the body-centered cubic lattice comprising the grain or crystals being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically of 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel, and second, high permeability grain-oriented silicon steel. Regular grain-oriented silicon steel is generally characterized by permeabilities of less than 1850 at 10 Oersteds with a core loss of greater that 0.400 watts per pound (WPP) at 1.5 Tesla at 60 Hertz for nominal 9-mil material. High permeability grain-oriented silicon steels are characterized by higher permeabilities which may be the result of compositional changes alone or together with process changes. For example, high permeability silicon steels may contain nitrites, sulfides, and/or borides which contribute to the precipitates and inclusions of the inhibition system which contribute to the properties of the final steel product. Furthermore, such high permeability silicon steels generally undergo cold reduction operations to final gauge wherein a final heavy cold reduction on the order of greater than 80% is made in order to facilitate the grain orientation. While such higher permeability materials are desirable, such materials tend to produce larger magnetic domains than conventional materials. Generally, larger domains are deleterious to core loss.

It is known that one of the ways that domain size and thereby core loss values of electrical steels may be reduced is if the steel is subjected to any of various practices designed to induce localized strains in the surface of the steel. Such practices may be generally referred to as "domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight lines, or scribes generally spaced at regular intervals. The scribe lines are substantially transverse to the rolling direction and typically are applied to only one side of the steel.

It has been suggested in prior patent art that contaminants or intruders may be effective for refining the magnetic domain wall spacing of grain-oriented silicon steel. In addition to such patents, the common assignee of the present application has a U.S. Pat. No. 4,911,766 issued Mar. 27, 1990 for a method of refining magnetic domains of electrical steels using phosphorus.

This is achieved in accordance with the teachings of the aforesaid application by first removing the naturally occurring insulating coating know variously as forsterite or base glass, from the silicon steel sheet to provide limited exposure of the underlying silicon steel, usually in a pattern of lines. This can accomplished mechanically by various means, such as by a laser beam, electron beam scribing, or flux printing. Following the selective removal of lines of the insulating coating, the entire surface of the sheet is exposed to phosphorus-bearing compound. This may be achieved, for example, by roller coating the sheet with a phosphorus-bearing material in liquid form, followed by air curing. Thereafter, the phosphorus-coated sheet is subjected to a low temperature anneal in a reducing atmosphere. An anneal at a temperature of about 1650° F., for example, causes breakdown of the phosphorus-containing coating, releasing phosphorus vapor which attacks the exposed metal stripes. In the process described in the aforesaid co-pending application, phosphorus stripes are formed at the areas where the insulating coating has been removed by releasing phosphorus on the strip surface via hydrogen reduction of a phosphate coating. Phosphorus migrates to any exposed iron (such as that exposed by the stripes) and forms wedge-shaped particles.

While the invention described in the aforesaid U.S. Pat. No. 4,911,766 improves the permeability and core loss characteristics of the silicon steel sheets, the iron phosphide stripes not only desirably grow into the steel but also, depending on the degree of phosphiding, may grow above the level of the strip surface. Growth of the phosphide stripes above the surface is undesirable because it increases the surface roughness of the silicon steel sheets. This makes the sheets difficult to stack and decreases ease of transformer assembly.

SUMMARY OF THE PRESENT INVENTION

In accordance with the present invention, a method is provided for smoothing the surface of grain-oriented silicon steel having an insulation base coating thereon and refined magnetic domains by the use of metallic contaminants. The method includes skin pass rolling of the sheet with contaminants thereon to smooth the surface by rolling the contaminants into the steel. The steel is then stress relief annealed to reduce the core loss. Particularly, the contaminant is phosphorus or phosphorus-bearing compounds which produce permanent wedge shaped bodies of phosphides which bond to the lines formed in the silicon steel sheets. Silicon steel sheets treated as aforesaid to form phosphide stripes at the areas where an insulting coating are removed are very lightly temper of skin-pass rolled to drive any wedges of a phosphorous-bearing compound into the underlying sheet while smoothing the surface of the sheet. The result is a surface-smoothing effect sufficient to satisfy the requirements of transformer manufacturers as regards stacking and slipping friction requirements. Thereafter, the sheet is stress-relief annealed to remove residual strains and to restore magnetic properties. It has been discovered that not only are the original improved properties due to the phosphorus-striping restored but the properties are additionally enhanced by the skin. pass plus stress-relief anneal operation.

Driving of the wedges of phosphide into the metal produces highly localized deformation in lines corresponding to the particle pattern, reproducing the geometry of the original scribed lines. Accordingly there is produced in the original phosphorus striped sample lines of mechanical deformation analogous to heavy mechanical scribing.

What is needed is an uncomplicated process for improving the surface roughness of grain oriented silicon steel having contaminants or intruders for domain refining, particularly for such steel having phosphide stripes. The method should be compatible with conventional processing and should result in magnetic properties at least as good as those prior to improving the surface roughness.

The above and other objects and features of the invention will become apparent form the following detailed description taken in connection with the accompanying drawings and in which:

FIGS. 1 and 2 are photomicrographs at ×800 showing the formation of phosphide particles "as grown" which protrude from the surface of the stripe prior to the invention; and FIGS. 3 and 4 are photomicrographs at ×400 and ×1000, respectively, showing improved surface smoothness and the formation of primary grains under phosphide particles after processing in accordance with the present invention.

DETAILED DESCRIPTION OF THE INVENTION

Figure 1:
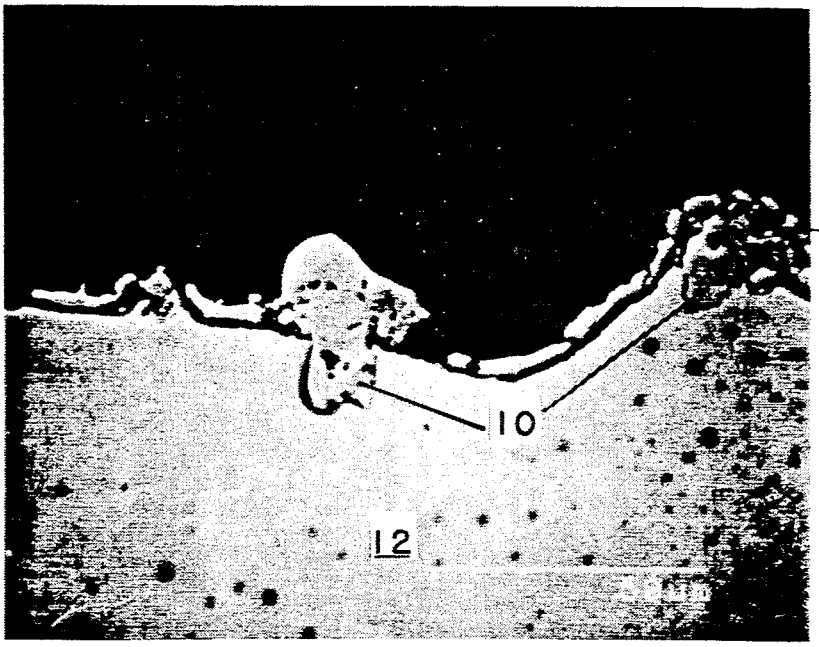

Broadly, in accordance with the present invention, a method is provided for improving the surface smoothness of the grain-oriented silicon steels and maintaining or improving the magnetic properties of such steels after effecting magnetic domain wall spacing by controlled contamination. The method is particularly suited for steels having surface bands or stripes using phosphorus and phosphorus compounds. Temper or skin-pass rolling alone produces a marked deterioration in the as-rolled properties of the silicon sheet material due to the extreme sensitivity of the domain structure to strain. However, when a stress-relief anneal is given to the very lightly rolled samples, localized areas of metal in the vicinity of particles which have been pushed into the metal recrystallize into primary grains. These localized areas of primary grains enhance the core loss properties over and above those of the parent phosphorus-striped sheets without temper rolling and stress relieving. Light rolling pressure is used to force the phosphide stripes into the underlying silicon steel such that the overall maximum elongation is less than 0.3 percent. Only at the tips of the phosphide wedges is there significant deformation of the metal.

Although the invention described herein has utility with electrical steels generally, and particularly 2% to 4.5% silicon electrical steels, such steels may be of the conventional grain-oriented or high permeability grain-oriented types. Such steels having relatively high permeability (e.g., 1850 at 10 Oersteds) usually have correspondingly relatively large grain sizes and would respond well to various domain refining techniques. The nominal composition (by weight percent) of a typical steel melt which may be used in carrying out the invention is: Carbon—0.030%; Nitrogen-less than 50 ppm; Manganese—0.038%; Sulfur—0.017%, Silicon—3.15%; Copper—0.30%, Boron—10ppm; and the balance iron and other steelmaking residuals and impurities.

Preferably the starting material for the chemical striping process is a final texture annealed, grain-oriented silicon steel sheet having an insulating coating thereon as described in the aforesaid co-pending U.S. patent application Ser. No. 206,152. Such an insulating coating can be the conventional base coating, called forsterite or mill glass, typically found on such silicon steels.

Initially, portions of the insulating coating are removed to expose a line pattern of the underlining silicon steel so as to expose the steel in areas where the coating has been removed. How the coating is removed is not critical except that the underlying steel should not be subjected to any mechanical, thermal, or other stresses and strains as a result of the coating removal operation. In other words, the exposed steel must be free of any thermal and plastic stresses prior to the subsequent step of applying the metallic contaminant.

After the line pattern of stripes is formed in the insulating coating to expose areas of the underlying silicon steel, it is subjected to an environment containing phosphorus or phosphorus-bearing compounds in which the controlled contamination of phosphorus into the steel can occur. There must be sufficient phosphorus present in order to react with the steel at the exposed portions and to attack the exposed silicon steel in the pattern defined by the removal of the striped portions of the base coating. Phosphorus vapor can be generated in situ by coating with phosphorus-bearing material and then heating the coated strip in a reducing atmosphere. Typical phosphorus-bearing coating compounds which can be used are described in the above-cited co-pending U.S. patent application Ser. No. 206,152. A typical compound contains 118 gm/1 phosphoric acid (85%), 18 gm/1 magnesium oxide, 20 ml/1 ammonium hydroxide (58%), 0.34 gm/1 chromic trioxide, and 1.0 ml/1 Dupanol (trade-mark) in an aqueous solution. After the sheet is coated with a material of this type, it is cured at about 800° F for one minute in air.

One embodiment of how the coating may be removed is described in co-pending U.S. patent application Ser. No. 414,962, filed Sep. 29, 1989 by the common Assignee of the present application. That application describes a method of simultaneous phosphorus flux-printing through the forsterite layer and charging the exposed lines of substrate metal with phosphorus.

The phosphorus-source layer may be applied by any conventional means such as dip or roller coating followed by subsequent air curing. The coating may be applied in thicknesses ranging from about 0.3 to 0.15 mils (0.75 to 2.25 microns) and may be applied to either one or both sides of the silicon steel strip. When applied directly to the steel strip, either on or in the vicinity of the exposed metal stripes, and when subsequently heated in a reducing atmosphere, the phosphorus vapor migrates along the silicon steel surface to the areas of exposed iron where it reacts to form wedge-shaped iron phosphide particles rooted in the steel. These are shown, for example, in the photo-micrographs at ×800 of FIGS. 1 and 2. Note that the wedge-shaped iron phosphide bodies 10 not only extend into the surface of the silicon steel 12 but also form a protuberance 14 above the surface of the sheet, giving rise to a rough surface and the poorer stacking characteristics described above.

Figure 2:
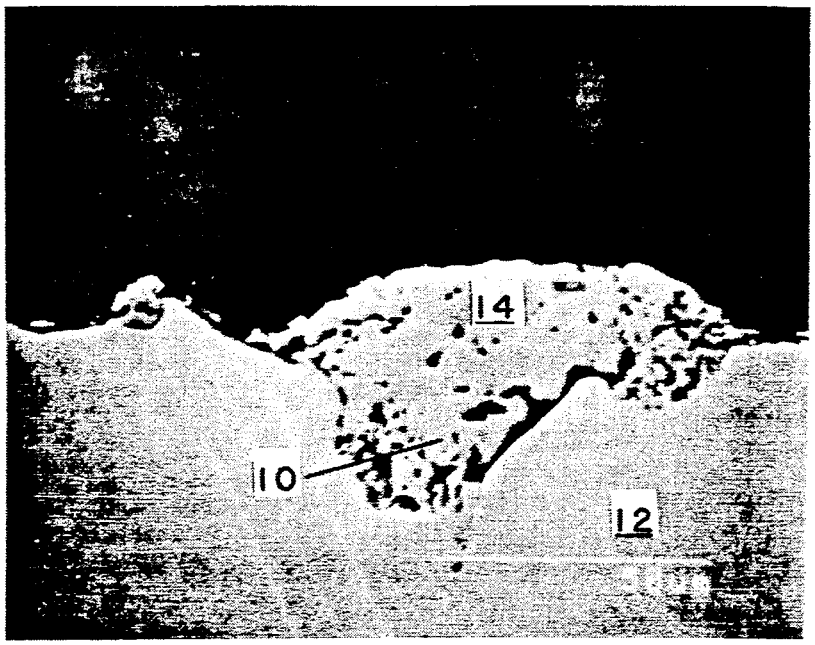

As was explained above, steels produced in accordance with the foregoing method and which are not subjected to further processing produce a roughened surface (FIGS. 1 and 2). The improvement of the present invention includes the step of driving the protuberances 14 of phosphide bodies 10 into the base metal to provide highly localized deformation in lines corresponding to the particle pattern. Thus, there is produced in the original phosphorus striped sample lines of mechanical deformation analogous to mechanical scribing. This is followed by a conventional stress relief annealing, such as at a temperature of about 1475° F. for about one-half hour.

The effect of skin pass rolling followed by a stress relief anneal is tabulated in the following Table.

about 3.15 percent silicon. All of the samples had been phosphorus-striped and were slightly rough to the touch due to above-surface phosphide growth and resulting protuberances. Initial tests on the as-scrubbed final texture annealed strips, before striping, showed a rather wide spread in Mu10 permeability of 1866–1937. Core losses at 1.5 Tesla also showed a wide spread of 0.361–0.503 watts per pound (wpp) with a mean of about 0.441 wpp. After phosphorus-striping, the core loss at 1.5 T had a spread of 0.369–0.489 wpp with a lowered mean of 0.415 wpp, representing a 6% improvement in core loss resulting from the phosphorus striping operation alone.

The seven Epstein strips were then given a very light pass in a rolling mill, the maximum overall elongation being 0.3% with most of the samples receiving less than half of that amount. Rolling pressure was minimized to produce as little overall deformation as possible consistent with reproducing on the strip smoothness approaching that of the condition achieved by cold-rolling rolls. This rolling is referred to in other places herein as a "temper" or "skin-pass" rolling procedure. While no measurable change in gage could be detected, there was a considerable improvement in smoothness to the touch, confirming that the phosphide protuberances had been driven into the metal by the skin-pass rolling step. By the skin pass rolling of the present invention, it is preferred that little if any elongation occurs, such that no more than 0.5%, preferably no more than 0.3%, and most preferably none occurs. It should be understood, however, that the amount of skin pass rolling pressure will depend upon the size and shape of contaminant particles. For phosphide wedge-shaped bodies, an elongation of 0.3% maximum is preferred. There should be no substantial gage change.

While skin pass rolling results in an improvement in the smoothness of the silicon steel sheet surface, the magnetic properties are adversely affected. See, for example, the Group C columns on the Table. The B-H hysteresis loop had been considerably tilted by the cold work to the extent that Mu10, normally a measure of texture, fell by about 450 points. The core losses show a correspondingly large deterioration. However, up on

TABLE

| | A As-scrubbed | | | B Phosphorus-striped | | | C Phosphorus-striped plus skin-pass | | | D Phosphorus-striped plus skin-pass plus S.R.A. | | |
|---|---|---|---|---|---|---|---|---|---|---|---|---|
| | Permeability | Core Loss (WPP) | | Permeability | Core Loss (WPP) | | Permeability | Core Loss (WPP) | | Permeability | Core Loss (WPP) | |
| Sample No. | Mu 10 | 1.5 T | 1.7 T | Mu 10 | 1.5 T | 1.7 T | Mu 10 | 1.5 T | 1.7 T | Mu 10 | 1.5 T | 1.7 T |
| VDTS11 | 1920 | .438 | .601 | 1911 | .383 (−13)* | .536 | 1378 | .919 (+110)* | 1.035 | 1875 | .403 (−8)* | .580 |
| VDTS13 | 1885 | .503 | .704 | 1877 | .489 (−3) | .697 | 1432 | .886 (+76) | 1.025 | 1854 | .414 (−18) | .607 |
| VDTS14 | 1866 | .470 | .656 | 1858 | .445 (−5) | .630 | 1520 | .847 (+80) | 1.018 | 1836 | .448 (−5) | .664 |
| VDTS15 | 1868 | .459 | 6.59 | 1863 | .456 (−1) | .659 | 1748 | .684 (+49) | .945 | 1852 | .428 (−7) | .627 |
| VDTS16 | 1924 | .435 | .612 | 1908 | .381 (−12) | .540 | 1637 | .770 (+77) | .954 | 1886 | .358 (−18) | .519 |
| VDTS17 | 1937 | .420 | .596 | 1919 | .380 (−10) | .524 | 1733 | .704 (+68) | .930 | 1904 | .350 (−17) | .476 |
| VDTS18 | 1911 | .361 | .519 | 1898 | .369 (+2) | .504 | 1366 | 1.019 (+182) | 1.129 | 1852 | .364 (+1) | .542 |
| Average of Single Strips | 1902 | .441 | .621 | 1891 | .415 (−6) | .584 (−6) | 1545 | .833 (+89) | 1.005 (+62) | 1866 | .395 (−10) | .571 (−8) |

*Nos. in parentheses = % change from "as-scrubbed" sample

The magnetic test results in the Table were conducted on seven Epstein strips of silicon steel containing stress relief annealing at 1475° F. (for Group D columns in the Table) the magnetic properties of the steel recovered; and six of the seven strips showed better core loss than in their previous phosphorus-striped condition. The average improvement core loss at 1.5T was 10% compared with 6% with the phosphorus stripe alone (Group B). Permeability did not return to the phosphorus-striped value (Group B in the Table), even with the stress-relief anneal but remained about 30 points lower. Although the reason is not clear for the permeability deterioration, the improvement in the more important core loss property is significant.

Figure 3:
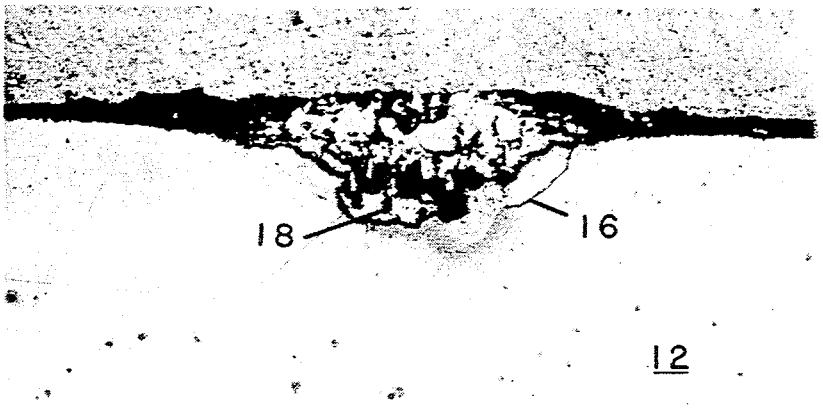
Figure 4:
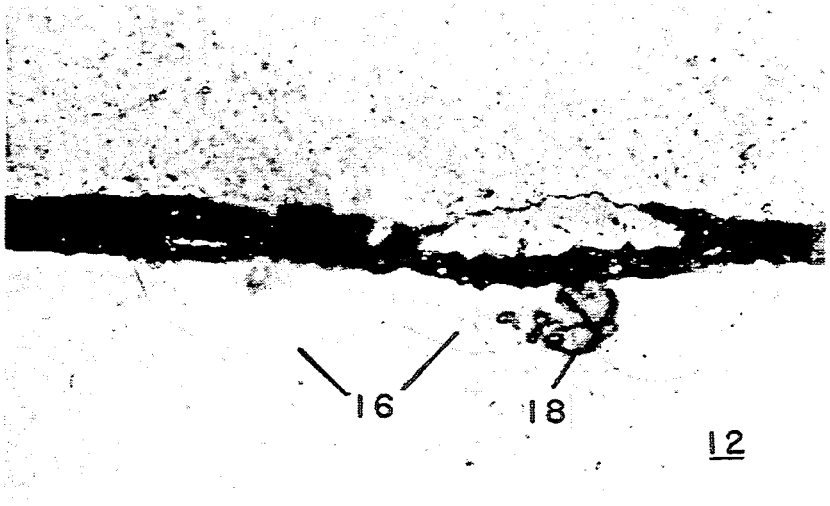

The photomicrographs of FIGS. 3 and 4 are of Epstein strips subjected to a skin pass rolling step plus subsequent stress relief annealing in accordance with the invention. Each FIG. 3 and 4 shows bunches of primary grains 16 under the phosphide wedges 18. The primary grains were sporadic and rarely extended all the way through the strip thickness.

The present invention thus provides a method for decreasing surface roughness of silicon steel as sheets which have been phosphorus-striped to effect domain refinement. Using the process of the invention not only is smoothness attained but, synergistically, core loss characteristics are generally improved. The relatively small sacrifice in permeability is of little importance affecting the use of the steel in a transformer as compared with the benefit gained in core loss.

Although the invention has been described in connection with certain specific embodiments, it will be readily apparent to those skilled in the art that various changes in process steps and composition of the silicon steel can be made to suit requirements without departing from the spirit and scope of the invention. Particularly, although the specific examples are directed to a method using phosphorus-striping to effect domain refinement, it is also applicable to methods using other contaminant or intruder elements and compounds to effect domain refinement.

We claim:

1. A method of providing a smooth surface on cube-on-edge grain-oriented silicon steel sheet having an insulation base coating thereon and having refined magnetic domain wall spacing by the use of metallic contaminants, the method comprising:

skin pass rolling the domain-refined sheet having the contaminants therein with rolling pressure to smooth the surface of the sheet by rolling the contaminants into the steel;

thereafter stress relief annealing the sheet to effect a core loss value.

2. The method of claim 1 wherein the skin pass rolling results in no substantial change in thickness of the sheet.

3. The method of claim 1 wherein the skin pass rolling produces no greater than 0.5% elongation of the sheet.

4. The method of claim 1 wherein the contaminant is selected from the group of phosphorous and phosphorus-bearing compounds.

5. The method of claim 1 wherein the rolling pressure utilized in the skin pass rolling strip is such as to produce primary grains in the sheet after the stress relief anneal.

* * * * *